US008021994B2

(12) United States Patent
Zumloh

(10) Patent No.: US 8,021,994 B2
(45) Date of Patent: Sep. 20, 2011

(54) TEXTILE FABRIC AND PROTECTIVE CLOTHING CONTAINING THE FABRIC

(75) Inventor: Regine Maria Zumloh, Mettmann (DE)

(73) Assignee: Teijin Aramid GmbH, Wuppertal (DE)

( * ) Notice: Subject to any disclaimer, the term of this patent is extended or adjusted under 35 U.S.C. 154(b) by 234 days.

(21) Appl. No.: 11/887,069

(22) PCT Filed: Apr. 21, 2006

(86) PCT No.: PCT/EP2006/003654

§ 371 (c)(1),
(2), (4) Date: Sep. 25, 2007

(87) PCT Pub. No.: WO2006/114238

PCT Pub. Date: Nov. 2, 2006

(65) Prior Publication Data

US 2009/0017300 A1 Jan. 15, 2009

(30) Foreign Application Priority Data

Apr. 26, 2005 (EP) ..... 05009082

(51) Int. Cl.

| | |
|---|---|
| ***D02G 3/04*** | (2006.01) |
| ***D02G 3/12*** | (2006.01) |
| ***D02G 3/18*** | (2006.01) |
| ***D02G 3/32*** | (2006.01) |

(52) U.S. Cl. ..... 442/197; 442/182; 442/184; 442/189; 442/199; 442/228; 442/229; 442/306; 442/310; 442/311; 442/316; 428/364; 428/365; 428/373; 428/374; 428/397; 428/399

(58) Field of Classification Search ..... 442/306, 442/310, 311, 316, 182, 184, 189, 197, 199, 442/228, 229; 428/364, 365, 373, 374, 397, 428/399

See application file for complete search history.

(56) References Cited

U.S. PATENT DOCUMENTS

| | | | | |
|---|---|---|---|---|
| 3,007,227 | A * | 11/1961 | Moler | 442/184 |
| 3,596,458 | A * | 8/1971 | Nakano et al. | 57/2 |
| 4,519,201 | A * | 5/1985 | Toon | 57/252 |
| 5,827,611 | A * | 10/1998 | Forbes | 428/375 |
| 5,851,668 | A * | 12/1998 | Sandor et al. | 428/397 |
| 6,080,474 | A * | 6/2000 | Oakley et al. | 428/323 |
| 6,260,344 | B1 * | 7/2001 | Chakravarti | 57/230 |
| 6,381,940 | B1 | 5/2002 | Kolmes et al. | |
| 6,534,175 | B1 | 3/2003 | Zhu et al. | |
| 2003/0040240 | A1 | 2/2003 | Thomas et al. | |
| 2003/0228821 | A1 | 12/2003 | Zhu et al. | |
| 2004/0065072 | A1 * | 4/2004 | Zhu et al. | 57/314 |
| 2005/0091961 | A1 | 5/2005 | Prickett | |

FOREIGN PATENT DOCUMENTS

| | | | |
|---|---|---|---|
| EP | 0 445 872 | A1 | 9/1991 |
| EP | 1 148 159 | A1 | 10/2001 |
| WO | WO 2005/042816 | A1 | 5/2005 |

OTHER PUBLICATIONS

Definition "sheath-core fibers" Complete Textile Glossary, Celanese Acetate LLC, copyright 2001.*

* cited by examiner

*Primary Examiner* — Andrew Piziali
(74) *Attorney, Agent, or Firm* — Oliff & Berridge, PLC

(57) ABSTRACT

A textile fabric is presented comprising at least a first and a second twisted thread, the first and the second twisted threads containing at least one cut resistant yarn as one component, and the second twisted thread containing a non-cut resistant yarn as a further component, and the non-cut resistant yarn of the second twisted thread consisting of elastomeric fibers. Further, protective clothing is presented, which contains the textile fabric.

19 Claims, No Drawings

TEXTILE FABRIC AND PROTECTIVE CLOTHING CONTAINING THE FABRIC

The present invention relates to a textile fabric and protective clothing containing the fabric.

Cut resistant textile fabrics are known. EP-A 0 445 872 describes protective clothing manufactured be weaving, plaiting or knitting a twisted composite yarn, the composite yarn comprising at least one wire strand and one spun-fiber yarn composed of a polyolefin with an average molar mass of at least 600,000 g/mol. Indeed, protective clothing manufactured with this composite yarn exhibits a certain flexibility. However, there exists a need for protective clothing with still higher flexibility, but no decrease in protective effect. Therefore, the object of the present invention is to provide a textile fabric that shows no loss of protective effect at increased flexibility.

This object is achieved by a textile fabric comprising at least a first and a second twisted thread, the first and the second twisted thread containing at least one cut resistant yarn as one component, and the second twisted thread containing a non-cut resistant yarn as a further component, and the non-cut resistant yarn of the second twisted thread consisting of elastomeric fibers.

Within the context of the present invention, a cut resistant or non-cut resistant yarn, respectively, is understood to be a yarn that, processed into a knitted fabric with a mass per unit area of 800 g/m$^2$, has a cut resistance determined according to DIN EN 388 of $\geqq 1$ or of $<1$, respectively.

In comparison to the prior art mentioned in the opening paragraph, the textile fabric according to the invention shows an increased flexibility and at least the same high value for the cut resistance, measured according to DIN EN 388.

The first and second twisted threads can contain as the cut resistant component at least one filament yarn that can be textured and has a linear density that lies, for example, in the range of 20 to 2000 dtex. Preferably, the first and second twisted threads contain, however, at least one staple fiber yarn whose linear density lies, for example, in the range of 140 to 3500 dtex. In a more preferred embodiment, the staple fiber yarn comprises an aromatic polyamide, for example, a p-aramid such as Twaron®, or comprises a polyolefin with an average molecular weight of at least 600,000 g/mol, for example, a polyethylene such as Dyneema® or a polypropylene. Additionally, staple fibers of other materials can be added to the previously mentioned staple fiber yarns during their manufacture in an amount that does not essentially affect the cut resistance of the staple fiber yarn. Such staple fibers of other materials can be, for example, fibers of an aliphatic polyamide, a polyester, a polylactic acid, or wool or cotton fibers.

Preferably the first twisted thread of the textile fabric according to the invention contains as a further component at least one filament of a cut resistant material, that comprises more preferably steel, ceramic, basalt, aluminum, copper, brass, silver, bronze, or glass. Staple fibers of the just mentioned materials can also be used as further components of the first twisted thread.

According to the invention, the non-cut resistant yarn of the second twisted thread consists of elastomeric fibers, that is, fibers that are extremely stretchable, and, after the release of tension, largely return to the original state. The elastomeric fibers preferably have a linear density in the range of 17 to 156 dtex.

Examples of elastomeric fibers that can serve as the non-cut resistant yarn of the second twisted thread are

- elastane fibers that are also known under the trade name Spandex or Dorlastan and consist of polyurethane,
- elastodiene fibers that, for example, consist of synthetic polyisoprene, or of polymers with a high molecular weight that are polymerized with one or more dienes, if need be with the addition of one or more vinyl monomers, or of elastic fibers of natural rubber,
- or fibers of polymers with a high molecular weight that consist of at least 85% segmented polyurethane, with elastane and elastodiene fibers being especially preferred, in particular when their stretchability lies in the range of >100 to approx. 800%, preferably in the range of >300 to approx. 800% and, in particular, preferably in the range of 400 to 550%.

In a preferred embodiment of the textile fabric according to the invention, neither the first twisted thread nor the second twisted thread has a sheath-core construction.

In a preferred embodiment of the textile fabric according to the invention, the first twisted thread consists of a steel filament and an aramid staple fiber yarn.

In a further preferred embodiment of the textile fabric according to the invention, the first twisted thread consists of a steel filament and two aramid staple fiber yarns.

In a further preferred embodiment of the textile fabric according to the invention, the first twisted thread consists of a steel filament and four aramid staple fiber yarns.

In a further preferred embodiment of the textile fabric according to the invention, the second twisted thread consists of an elastane yarn and an aramid staple fiber yarn.

In a further preferred embodiment of the textile fabric according to the invention, the second twisted thread consists of an elastane yarn and two aramid staple fiber yarns.

In a particularly preferred embodiment of the textile fabric according to the invention, the first twisted thread consists of one or two steel filaments and four aramid staple fiber yarns, and the second twisted thread consists of an elastane yarn and two aramid staple fiber yarns.

In the textile fabric according to the invention, the at least first and second twisted threads are preferably processed together, more preferably woven, knitted, plaited or crocheted. The at least two twisted threads can thus be, together and at the same time, fed into a knitting, plaiting or weaving machine and processed into the textile fabric according to the invention. For this purpose, the at least two twisted threads can be fed and processed in parallel arrangement, or they can also be processed twisted around each other.

The previously cited combination of high flexibility and cut resistance of the textile fabric according to the invention causes the stated combination of qualities to also have an effect in an advantageous manner in protective clothing that contains the textile fabric according to the invention. Therefore, protective clothing of this type is also an object of the present invention.

Preferred embodiments of the protective clothing according to the invention are gloves, aprons, pants, jackets, sleeves, hoses, hose jackets or vandalism-resistant articles, such as, for example, seats.

The present invention will now be described in more detail by way of the following examples.

EXAMPLE 1

For the manufacture of a glove, initially a first twisted thread is manufactured in a two-step twisting process. In the first step thereof, two threads of metal filament (linear density 150 dtex in each case), which are available under the trade name Bekinox from Bekaert, and two staple fiber yarns (linear density 357 dtex in each case) of p-aramid, which is available under the trade name Twaron from Teijin Twaron, are twisted. The resulting twisted thread is subsequently twisted in the second step with two twisted p-aramid staple fiber yarns of the previously mentioned type, which results in the first twisted thread.

For the production of a second twisted thread, an elastane yarn (linear density=78 dtex), which is available under the trade name Dorlastan from Dorlastan Fibers, is twisted with two staple fiber yarns (linear density 357 dtex in each case) of p-aramid, which is available from Teijin Twaron under the trade name Twaron.

The first and second twisted threads are fed together and in parallel into a knitting machine and knitted with a needle gauge of 7 needles per 2.54 cm into a glove. The glove has a weight of 32.9 g, a mass per unit area of 508 g/m$^2$, and a knit thickness of 1.74 mm, and exhibits a mesh density of 4 stitches per cm in wales and courses respectively.

Gloves that manufactured in the manner just described are designated in the following as gloves of Type 1.

On the gloves of Type 1, the cut resistance was measured according to DIN EN 388. The Type 1 glove yielded in ten measurements a lowest average cut index of 20.9, which corresponds to the highest performance level 5. The lowest individual index determined was 13.1. Thus, this glove is to be classified with regard to cut resistance in the second highest performance level 4.

This example shows that gloves manufactured according to the invention have a higher cut resistance than gloves known from the prior art. Further, gloves manufactured according to the invention have a higher flexibility, that is, a higher wear comfort than gloves known from the prior art.

EXAMPLE 2

For the manufacture of a glove, initially a first twisted thread is manufactured in a two-step twisting process. In the first step thereof, two threads of metal filament (linear density 150 dtex in each case), which are available under the trade name Bekinox from Bekaert, and two staple fiber yarns (linear density 200 dtex in each case) consisting of 70 wt. % polylactic acid (PLA) staple fibers, which are available under the trade name Ingeo from Cargill Dow, and 30 wt. % p-aramid staple fibers, which are available under the trade name Twaron from Teijin Twaron, are twisted. The resulting twisted thread is subsequently twisted in the second step with two twisted p-aramid staple fiber yarns of the previously mentioned type, which results in the first twisted thread.

For the production of a second twisted thread, an elastane yarn (linear density=78 dtex), which is available under the trade name Dorlastan from Bayer, is twisted with two staple fiber yarns (linear density 200 dtex in each case) consisting of 70 wt. % polylactic acid (PLA) staple fibers, which are available under the trade name Ingeo from Cargill Dow, and 30 wt. % p-aramid staple fibers, which are available under the trade name Twaron from Teijin Twaron.

The first and second twisted threads are fed together and in parallel into a knitting machine and knitted with a needle gauge of 7 needles per 2.54 cm into a glove. The glove has a weight of 20.6 g, a mass per unit area of 360 g/m$^2$, and a knit thickness of 1.56 mm, and exhibits a mesh density of 5.5 wales/cm and 3.5 courses/cm.

A cut resistance of at least 4.8 was measured, according to DIN EN 388, on two of the gloves manufactured in such a manner. Thus, these gloves are to be classified with regard to cut resistance in performance level 2.

This example shows that gloves manufactured according to the invention, even in the case where yarns consisting of only 30 wt. % of a cut resistant material (p-aramid staple fibers) and 70 wt. % of non-cut resistant material (PLA) are used in the first and in the second twisted threads, the gloves still show at least a cut resistance of performance level 2, and this at a weight of only 20.6 g.

EXAMPLE 3

For the manufacture of a glove, initially a first twisted thread is manufactured in a one-step twisting process. For that purpose, two threads of metal filament (linear density 150 dtex in each case), which are available under the trade name Bekinox from Bekaert, and two textured filament yarns (linear density 550 dtex in each case) of p-aramid, which is available under the trade name Twaron from Teijin Twaron, are twisted.

For the production of a second twisted thread, an elastane yarn (linear density=78 dtex), which is available under the trade name Dorlastan from Bayer, is twisted with a filament yarn (linear density 550 dtex) of p-aramid, which is available from Teijin Twaron under the trade name Twaron.

The first and second twisted threads are fed together and in parallel into a knitting machine and knitted with a needle gauge of 7 needles per 2.54 cm into a glove. The glove has a weight of 24.9 g, a mass per unit area of 479 g/m$^2$, and a knit thickness of 2.1 mm, and exhibits a mesh density of 3.5 courses/cm and 6.5 wales/cm.

A cut resistance of at least 14.4 was measured, according to DIN EN 388, on two gloves manufactured in such a manner. Thus, these gloves are to be classified with regard to cut resistance in the second highest performance level 4.

This example shows that gloves manufactured according to the invention, can be manufactured at a cut resistance in performance level 4, which only weigh 24.9 g.

EXAMPLE 4

For the manufacture of a glove, initially a first twisted thread is manufactured in a one-step twisting process. For this purpose, a thread of metal filament (linear density 150 dtex), which is available under the trade name Bekinox from Bekaert, and two staple fiber yarns (linear density 200 dtex in each case) of p-aramid, which is available under the trade name Twaron from Teijin Twaron, are twisted.

For the production of a second twisted thread, an elastane yarn (linear density 78 dtex), which is available under the trade name Dorlastan from Dorlastan Fibers, is twisted with two staple fiber yarns (linear density 357 dtex in each case) of p-aramid, which is available from Teijin Twaron under the trade name Twaron.

The first and second twisted threads are fed together and in parallel into a knitting machine and knitted with a needle gauge of 13 needles per 2.54 cm into a glove. The glove has a weight of 20.9 g, a mass per unit area of 347 g/m$^2$, and a knit thickness of 1.21 mm, and exhibits a mesh density in the wale direction of 8 stitches per cm and a mesh density in the course direction of 6.5 stitches per cm.

A cut resistance of at least 6.9 was measured, according to DIN EN 388, on five gloves manufactured in such a manner. Thus, these gloves are to be classified with regard to cut resistance in the third highest performance level 3.

The comparison of this example with Example 1 shows that the gloves from Example 4, despite a 32% lower mass per unit area and despite a 36% lower weight, still have a cut resistance of class 3. Thus, Example 3 shows, that gloves according to the invention can be manufactured, which unite a cut resistance in the third highest performance level with a very high wear comfort and with a very high dexterity, that is, with a very high flexibility and prehensility.

EXAMPLE 5

For the manufacture of a glove, initially a first twisted thread is manufactured in a one-step twisting process. For this purpose, two threads of metal filament (linear density 150 dtex in each case), which are available under the trade name Bekinox from Bekaert, and four staple fiber yarns (linear density 357 dtex in each case) of p-aramid, which is available under the trade name Twaron from Teijin Twaron, are twisted.

For the production of a second twisted thread, an elastane yarn (linear density=78 dtex), which is available under the trade name Dorlastan from Dorlastan Fibers, is twisted with two staple fiber yarns (linear density 357 dtex in each case) of p-aramid, which is available from Teijin Twaron under the trade name Twaron.

The first and second twisted threads are fed together and in parallel into a knitting machine and knitted with a needle gauge of 7 needles per 2.54 cm into a glove. The glove has a weight of 32.9 g, a mass per unit area of 508 g/m$^2$, and a knit thickness of 1.74 mm, and exhibits a mesh density of 4 stitches per cm in wales and courses, respectively.

Gloves were manufactured in the manner described above and the cut resistance was measured according to DIN EN 388. The gloves yielded in ten measurements a lowest average cut index of 20.9, which corresponds to the highest performance level 5. The lowest individual index determined was 13.1. Thus, these gloves are to be classified with regard to cut resistance in the second highest performance level 4.

This example shows that gloves manufactured according to the invention have a higher cut resistance than gloves known from the prior art. Further, gloves manufactured according to the invention have a higher flexibility, that is, a higher wear comfort than gloves known from the prior art.

EXAMPLE 6

For the manufacture of a glove, initially a first twisted thread is manufactured in a one-step twisting process. For this purpose, two threads of metal filament (linear density 150 dtex in each case), which are available under the trade name Bekinox from Bekaert, and four staple fiber yarns (linear density 200 dtex in each case) consisting of 70 wt. % polylactic acid (PLA) staple fibers, which are available under the trade name Ingeo from Cargill Dow, and 30 wt. % p-aramid staple fibers, which are available under the trade name Twaron from Teijin Twaron, are twisted.

For the production of a second twisted thread, an elastane yarn (linear density=78 dtex), which is available under the trade name Dorlastan from Bayer, is twisted with two staple fiber yarns (linear density 200 dtex in each case) consisting of 70 wt. % polylactic acid (PLA) staple fibers, which are available under the trade name Ingeo from Cargill Dow, and 30 wt. % p-aramid staple fibers, which are available under the trade name Twaron from Teijin Twaron.

The first and second twisted threads are fed together and in parallel into a knitting machine and knitted with a needle gauge of 7 needles per 2.54 cm into a glove. The glove has a weight of 20.6 g, a mass per unit area of 360 g/m$^2$, and a knit thickness of 1.56 mm, and exhibits a mesh density of 5.5 wales/cm and 3.5 courses/cm.

A cut resistance of at least 4.8 was measured, according to DIN EN 388, on two gloves manufactured in such a manner. Thus, these gloves are to be classified with regard to cut resistance in performance level 2.

This example shows that gloves manufactured according to the invention, even in the case where yarns consisting of only 30 wt. % of a cut resistant material (p-aramid staple fibers) and 70 wt. % of non-cut resistant material (PLA) are used in the first and in the second twisted threads, the gloves still show at least a cut resistance of performance level 2, and this at a weight of only 20.6 g.

The invention claimed is:

1. A textile fabric comprising at least a first and a second twisted thread, the first and the second twisted thread containing at least one cut resistant yarn as one component, the first twisted thread containing at least one filament of a cut resistant material as a further component, and the second twisted thread containing a non-cut resistant yarn as a further component, wherein the non-cut resistant yarn of the second twisted thread consists of elastomeric fibers, and neither the first twisted thread nor the second twisted thread has a sheath-core construction.

2. A textile fabric according to claim 1, wherein the first and second twisted threads contain at least one staple fiber yarn as one cut resistant component.

3. A textile fabric according to claim 2, wherein the at least one staple fiber yarn consists of an aromatic polyamide or of a polyolefin with an average molecular weight of at least 600,000 g/mol.

4. A textile fabric according to claim 1, wherein the filament consists of steel, ceramic, basalt, aluminum, copper, bronze, brass, silver, or glass.

5. A textile fabric according to claim 1, wherein the elastomeric fibers are elastane fibers or elastodiene fibers.

6. A textile fabric according to claim 5, wherein the elastomeric fibers have a stretchability in the range of >100 to 800%.

7. A textile fabric according to claim 1, wherein the first twisted thread consists of a steel filament and an aramid staple fiber yarn.

8. A textile fabric according to claim 1, wherein the first twisted thread consists of a steel filament and two aramid staple fiber yarns.

9. A textile fabric according to claim 1, wherein the first twisted thread consists of a steel filament and four aramid staple fiber yarns.

10. A textile fabric according to claim 1, wherein the second twisted thread consists of an elastane yarn and an aramid staple fiber yarn.

11. A textile fabric according to claim 1, wherein the second twisted thread consists of an elastane yarn and two aramid staple fiber yarns.

12. A textile fabric according to claim 1, wherein the first twisted thread consists of two steel filaments and four aramid staple fiber yarns, and the second twisted thread consists of an elastane yarn and two aramid staple fiber yarns.

13. A textile fabric according to claim 1, wherein the at least first and second twisted threads in the textile fabric are processed together.

14. A textile fabric according to claim 1, wherein it is woven, knitted, plaited or crocheted.

15. A textile fabric according to claim 1, wherein the at least two twisted threads are, in parallel arrangement, fed into a knitting, weaving or plaiting machine and processed.

16. Protective clothing containing a textile fabric according to claim 1.

17. Protective clothing according to claim 16 in the form of gloves, aprons, pants, jackets, sleeves, hoses, hose jackets or vandalism-resistant articles.

18. A textile fabric according to claim 10, wherein the elastane yarn has a linear density in the range of 17 to 156 dtex.

19. The textile fabric according to claim 1, wherein the first and the second twisted threads comprise at least one different component.

* * * * *

UNITED STATES PATENT AND TRADEMARK OFFICE

CERTIFICATE OF CORRECTION

PATENT NO. : 8,021,994 B2
APPLICATION NO. : 11/887069
DATED : September 20, 2011
INVENTOR(S) : Regine Maria Zumloh It is certified that error appears in the above-identified patent and that said Letters Patent is hereby corrected as shown below:

Change "(linear density 78 dtex)" at column 4, line 41 to "(linear density=78 dtex)"

Signed and Sealed this
Eighth Day of November, 2011

David J. Kappos

David J. Kappos
*Director of the United States Patent and Trademark Office*